US007992510B2

(12) United States Patent
Dial

(10) Patent No.: US 7,992,510 B2
(45) Date of Patent: Aug. 9, 2011

(54) PERSONAL WATERCRAFT

(76) Inventor: Franklin D. Dial, Samson, AL (US)

( * ) Notice: Subject to any disclaimer, the term of this patent is extended or adjusted under 35 U.S.C. 154(b) by 233 days.

(21) Appl. No.: 12/361,903

(22) Filed: Jan. 29, 2009

(65) Prior Publication Data

US 2010/0190391 A1 Jul. 29, 2010

(51) Int. Cl.
*B63C 11/46* (2006.01)

(52) U.S. Cl. ..... 114/315

(58) Field of Classification Search ..... 114/315, 114/253; 441/65
See application file for complete search history.

(56) References Cited

U.S. PATENT DOCUMENTS

D323,808 S * 2/1992 DeSantis ..... D12/308
5,167,550 A * 12/1992 Nielsen ..... 440/84
5,704,817 A * 1/1998 Vaughn ..... 440/33
5,878,687 A * 3/1999 Grimmeisen ..... 114/315
6,748,894 B1 6/2004 Dunn et al.
D549,636 S * 8/2007 Dial ..... D12/300

* cited by examiner

*Primary Examiner* — Stephen Avila

(57) ABSTRACT

A personal watercraft is provided that is capable of achieving high speeds. The craft can operate on a surface of a body of water or beneath the surface of the body of water. The personal watercraft includes a hull, a streamlined water tunnel disposed within the hull, a plurality of fins extending from the hull, a propeller disposed within the water tunnel, a motor disposed within the hull and outside of the water tunnel, a water intake at the front of the water tunnel and at the front and bottom of the hull, first and second water exhausts at the rear of the water tunnel and at the rear and bottom of the hull, and first and second handgrips located at the rear of the hull. The propeller can pull water into the water tunnel via the water intake, and the amount of water entering the watercraft at any given time is substantially the same as the amount of water exiting the watercraft via the water tunnel and the water exhausts.

1 Claim, 4 Drawing Sheets

PERSONAL WATERCRAFT

FIELD OF INVENTION

The present invention relates generally to a watercraft that can tow a swimmer on the surface of a body of water or a diver beneath the water's surface. More particularly, the present invention relates to a watercraft that can achieve high speeds while allowing a towed swimmer or diver to maneuver the craft as desired.

BACKGROUND OF THE INVENTION

Traditionally, watercrafts have been designed to operate either on the surface of a body of water or as a submersible craft that can operate beneath the water's surface. For example, U.S. Pat. No. 5,704,817 to Vaughn entitled "Water Surface Propulsion Device" discloses an aquatic propulsion device that will only operate on a water's surface. Conversely, U.S. Pat. No. 6,748,894 to Dunn et al. entitled "Submersible Marine Vehicle" discloses a submersible marine vehicle.

The Vaughn patent discloses a device that includes a water intake chamber, which is a large open area that houses a motor and a propeller. However, the placement of both the motor and propeller inside the larger water intake chamber creates a large amount of turbulence. That is, water passes through the larger water chamber, around the motor, and through the propeller. Then, water is funneled through a tapered end of the chamber and into much narrower water output tubes. This flow of water creates a great amount of turbulence, and such turbulence greatly restricts the overall speed of the device.

Similarly, the Dunn et al. patent discloses a device that includes a hull housing both a propeller and a motor. The hull is much larger than the size of the propeller and motor. After water passes through the large hull and the propeller and past the motor, the water is funneled into much smaller outlet slots at the back end. This flow of water creates a great amount of turbulence and greatly restricts the overall speed of the device.

Furthermore, the Vaughn patent discloses the use of a trolling motor, and the Dunn et al. patent discloses a vehicle that appears to use a trolling motor. Accordingly, the vehicles disclosed in Vaughn and Dunn et al. are limited to low speeds.

Both the Vaughn and Dunn et al. patents disclose devices that incorporate motors and car-type batteries that are heavy. The added weight of these parts results in poor maneuverability of the device in which they are incorporated.

There is thus a continuing, ongoing need for a personal watercraft that can achieve high speeds and that allows for easy maneuverability. Preferably, such a watercraft achieves high speeds by reducing the turbulence of water as it flows through the craft and achieves easy maneuverability by reducing the weight of the craft.

SUMMARY OF THE INVENTION

According to the present invention, a personal watercraft that is capable of achieving high speeds is provided. The craft can operate on a surface of a body of water or beneath the surface of the body of water. The watercraft includes a hull, a streamlined water tunnel disposed within the hull, a plurality of fins extending from the hull, a propeller disposed within the water tunnel, a motor disposed within the hull and outside of the water tunnel, a water intake at the front of the water tunnel and at the front and bottom of the hull, first and second water exhausts at the rear of the water tunnel and at the rear and bottom of the hull, and first and second handgrips located at the rear of the hull.

The motor can control the propeller, and the propeller can pull water into the water tunnel via the water intake. The amount of water entering the watercraft at any given time is substantially the same as the amount of water exiting the watercraft via the water tunnel and the water exhausts. The water exhausts can be spaced apart from one another along the rear of the hull.

Accordingly, it is a benefit of the present invention to provide a personal watercraft that water enthusiasts can use as an alternative way to enjoy the water.

It is a further benefit of the present invention to provide a personal watercraft that can achieve high speeds.

It is another benefit of the present invention to provide a personal watercraft that is easy to maneuver.

If is yet another benefit of the present invention to provide a watercraft that assists in suspending a user's weight on the surface of the water so that the user will be able to operate the watercraft for long periods of time without tiring.

It is still a further benefit of the present invention to provide a watercraft that can be easily steered by a user.

It is yet another benefit of the present invention to provide a watercraft that allows a user to easily change speeds.

Finally, it is a benefit of the present invention to provide a watercraft that moves in a straight and level plane when in operation.

In accordance with the present invention, all of these benefits as well as others not herein specifically identified, are generally achieved by the present personal watercraft.

BRIEF DESCRIPTION OF THE DRAWINGS

Various examples of objects, features and attendant advantages of the present invention will become fully appreciated as the same becomes better understood when considered in conjunction with the accompanying drawings, wherein.

DESCRIPTION OF THE PREFERRED EMBODIMENTS

Figure 1:
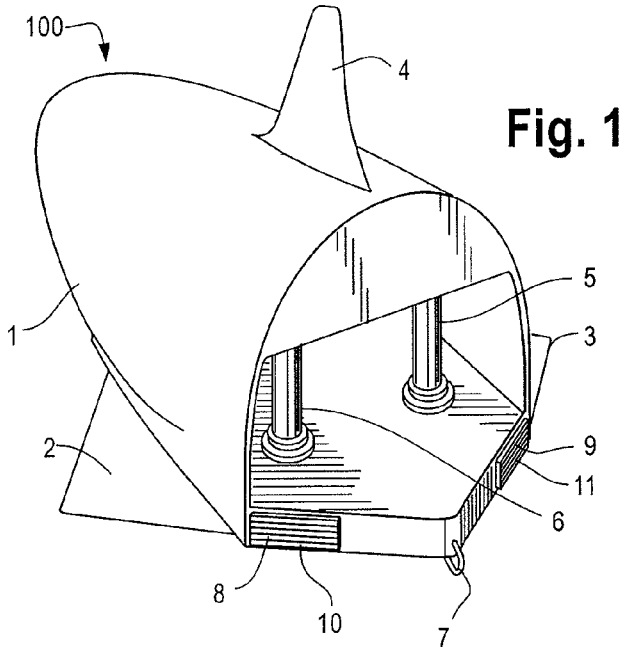
FIG. 1 is a perspective view of a personal watercraft in accordance with the present invention.

While this invention is susceptible of an embodiment in many different forms, there are shown in the drawings and will be described herein in detail specific embodiments thereof with the understanding that the present disclosure is to be considered as an exemplification of the principles of the invention. It is not intended to limit the invention to the specific illustrated embodiments.

Embodiments of the present invention include a watercraft that can achieve high speeds and is easy to maneuver. The shape, design, and weight of the watercraft result in less friction on the water and less turbulence as the craft travels through the water, which contributes to the high speed and easy maneuverability of the craft.

A watercraft in accordance with the present invention can operate at, on, or near the surface of the water. In such embodiments, the watercraft can operate on the surface of the water such that only a small portion of the craft is below the surface of the water. A user, for example, a swimmer, using the watercraft in this embodiment can be supported by the watercraft or an accessory of the watercraft on the surface of the water.

In other embodiments, a watercraft in accordance with the present invention can operate below the surface of the water. In such embodiments, the watercraft could include enough added weight to make it submerge in water when desired. However, the watercraft could still be light enough to maneuver under water. A user, for example, a diver, can operate the watercraft under water.

A watercraft in accordance with the present invention can include a uniquely shaped, water-tight hull. Three fins can extend from the craft: one fin can be mounted on each side of the watercraft along the bottom of and near the rear of the craft, and one fin can be mounted on top of and near the rear of the craft. The fins that extend from the watercraft allow the craft to travel in a straight and level plane when in operation. In embodiments in which the watercraft can operate on, at, or near the surface of the water, the two side fins can be under the water's surface during operation of the craft.

A watercraft in accordance with the present invention can also incorporate a streamlined water tunnel that creates a constant flow of water. That is, the water intake at the front of the craft can be the same amount as the water exhaust at the back of the craft. The consistency of the water flow through the craft and the streamlined shape of the water tunnel minimize turbulence.

The water tunnel can be included inside the hull of the watercraft, and the water tunnel can be attached and sealed to the hull at the water intake and the water exhausts. The water intake can be located near the front and bottom of the craft, and the water exhausts can be located near the bottom and rear of the craft. One water exhaust can be located on each side of the bottom rear of the craft. Additionally, the water tunnel can be attached to the hull at a plurality of points along the floor of the hull.

The water tunnel can be shaped to maximize water flow through the tunnel. That is, the water tunnel can be streamlined, and water can be pulled into the tunnel by a propeller.

The water tunnel can change shape from the front of the craft to the rear. That is, the water tunnel can be elongated and curved at the front of the craft where water is taken in. Gradually, the water tunnel can change shape to become round in the vicinity of the propeller. In embodiments of the present invention, only the propeller is located inside of the water tunnel and thus in the water flowing therethrough. Because water only must pass through the propeller as it travels through the water tunnel, turbulence is reduced. The water tunnel can be shaped such that the propeller has a close clearance to the inside wall of the water tunnel.

Behind the propeller, the water tunnel can split into two identical back tunnels, and each can allow the same amount of water to flow therethrough. At the end of the back tunnels, water can exit the watercraft such that the same amount of water exits the craft through each back tunnel. The design of the water tunnel and back tunnels creates a high degree of efficiency in the water flow through the craft. In embodiments in which the watercraft can operate on, at, or near the surface of the water, the water intake and water exhausts can be under the water's surface.

In embodiments of the present invention, the watercraft can incorporate a motor to power the craft and a battery to power the motor. The motor can be similar to motors found in battery powered tools, for example, cordless power tools such as a power skill saw and can be, for example, from approximately 18 to 36 volts. The types of battery and motor incorporated into the watercraft can reduce the weight of the craft. Accordingly, the maneuverability of the watercraft can be increased.

The speed of the propeller incorporated into the watercraft can vary and can be altered by changing gears. For example, the speed of the propeller can be determined by the size of the gear used at a far end of the propeller driveshaft. Accordingly, the watercraft can achieve high speeds.

Two handgrips can be mounted vertically in, at, or near the rear of the vehicle, and the handgrips can control the steering and throttle of the watercraft. For example, a user can hold onto the handgrips to steer the watercraft. The throttle can be controlled by turning one of the handgrips, for example, by turning the right handgrip, one quarter turn.

A rope or tether can be attached to the watercraft, for example, at or near the bottom center of the rear of the craft. In embodiments of the present invention, the far end of the rope or tether can be attached to a body board with sufficient buoyancy to support a user's weight. When a user's weight is suspended on the surface of the water, the user will be able to operate the watercraft for longer periods of time without tiring.

Referring now to FIG. 1, a perspective view of a personal watercraft 100 in accordance with the present invention is shown. The watercraft 100 includes a hull 1 and three fins 2, 3, and 4. The hull 1 can have a unique shape and is air and water-tight. The fins 2, 3, 4 can provide for stability of the hull. In embodiments of the present invention, the hull 1 can be approximately 25 inches in length, 15 inches in width, and 11 inches in height, for example.

One fin 4 can be located on the top center of the hull 1 near the rear of the hull 1, and the other two fins 2 and 3 can be located on the left and right sides, respectively, of the hull 1 along the bottom rear of the hull 1. The hull 1 and fins 2, 3, and 4 can be made from sheet aluminum, for example, and can be shaped, fitted and welded at the seams. Alternatively, the hull 1 and fins 2, 3, and 4 can be made from high impact plastic that is formed in molds.

Handgrips 5 and 6 can be located at or near the rear of the watercraft 100. The handgrips 5 and 6 can include rubber handgrips such as the type found on a motorcycle, for example, over a metal cylinder. One of the handgrips, for example, the right hand grip 5, can simultaneously be a throttle grip. The throttle grip can be capable of turning, for example, one quarter of a turn.

A ring or hook 7 can be attached to the watercraft 100 at or near the bottom center of the rear of the watercraft 100. A rope or tether, for example, can be attached to the ring 7 at a first end, and a second end of the rope or tether can be attached to a board or other device that is buoyant enough to support the weight of a user on the surface of the water. When a user is supported on a board or other device extending from a rope that is connected to the ring 7 of the watercraft 100, a user will only have to use his hands and arms to steer the watercraft 100.

Water exhausts 8 and 9 can also be included in the watercraft 100. Water traveling through the watercraft 100 can exit the craft 100 via the exhausts 8 and 9 near the rear of the craft. Louvers, for example, 10 and 11 can be mounted inside each exhaust 8 and 9 to direct water exiting the craft 100 to flow in a downward direction. This downward flow of the water exhaust can help offset the weight of a user's hands and arms holding on to the handgrips 5 and 6. Louvers 10 and 11 can be made from, for example, aluminum or high impact plastic.

Figure 2:
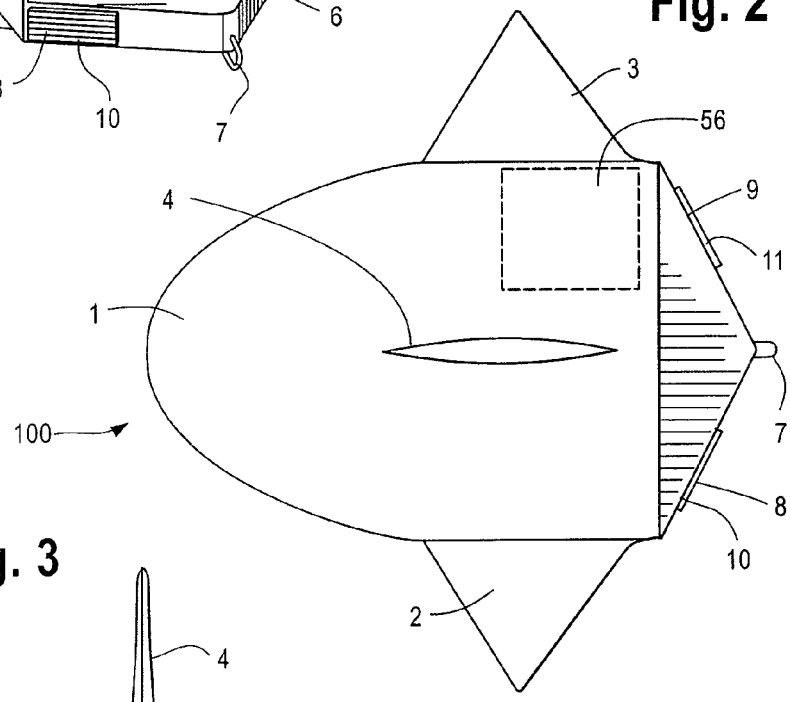
FIG. 2 is a top view of a personal watercraft in accordance with the present invention.

FIG. 2 is a top view of the watercraft 100 of FIG. 1. As seen in FIG. 2, the watercraft 100 can include a battery access hatch 56 to access the battery of the craft 100. The hatch 56 can be sealed and held in place by, for example, twist-lock tabs that allow for quick and easy access to the battery.

In embodiments of the present invention, the battery can be rechargeable. The battery can be mounted above the water tunnel, which will be explained in greater detail herein.

Figure 3:
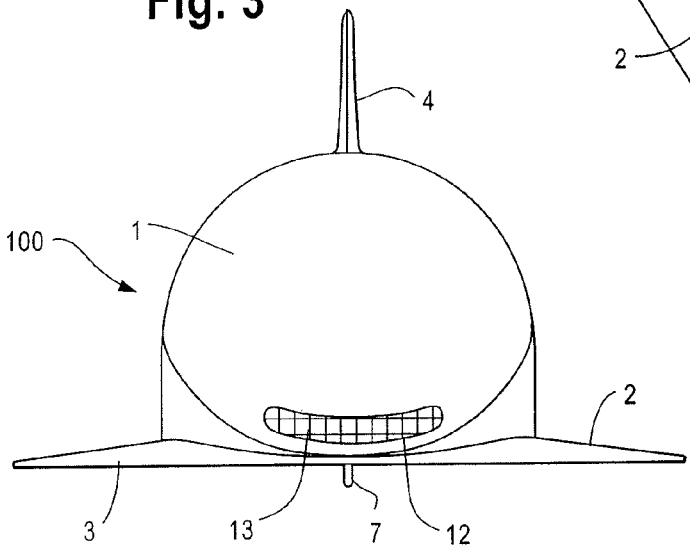
FIG. 3 is a front view of a personal watercraft in accordance with the present invention.

FIG. 3 is a front view of the watercraft 100 of FIG. 1. As seen in FIG. 3, the watercraft 100 can include a water intake 12, which can incorporate a debris screen 13. As water is drawn into the water intake 12, the debris screen 13 can keep out objects that may damage the propeller or other aspects of the watercraft 100. The debris screen can be made from stainless steel, aluminum, or high impact plastic, for example. The water intake 12 can be securely attached to the hull 1 of the craft 100 and can be completely sealed thereto.

Figure 4:
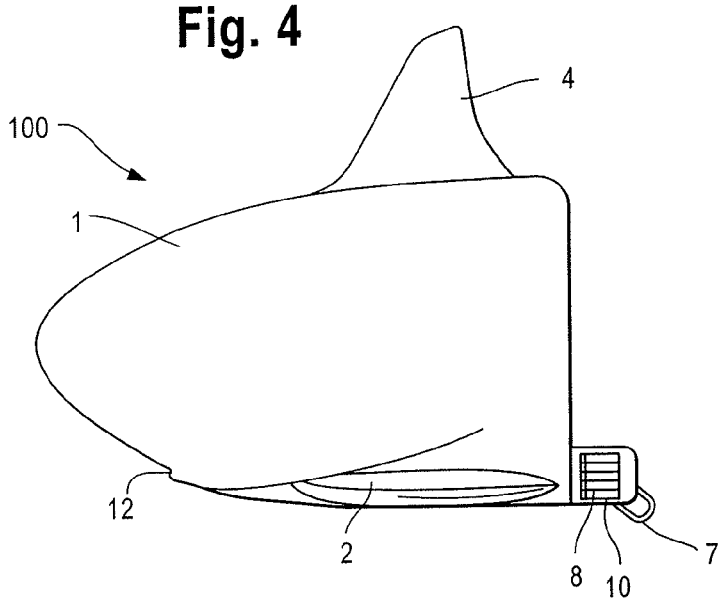
FIG. 4 is a left side view of a personal watercraft in accordance with the present invention.

Referring now to FIG. 4, a left side view of the watercraft 100 of FIG. 1 is shown. It is to be understood that the right side of the watercraft 100 is a mirror image of the left side. As seen in FIG. 4, a side fin 2 extends from the bottom rear of the craft 100. A water exhaust 8, including a louver 10, is located at the bottom rear of the craft 100, and a ring 7 is located at the center of the bottom rear of the craft 100.

Figure 5:
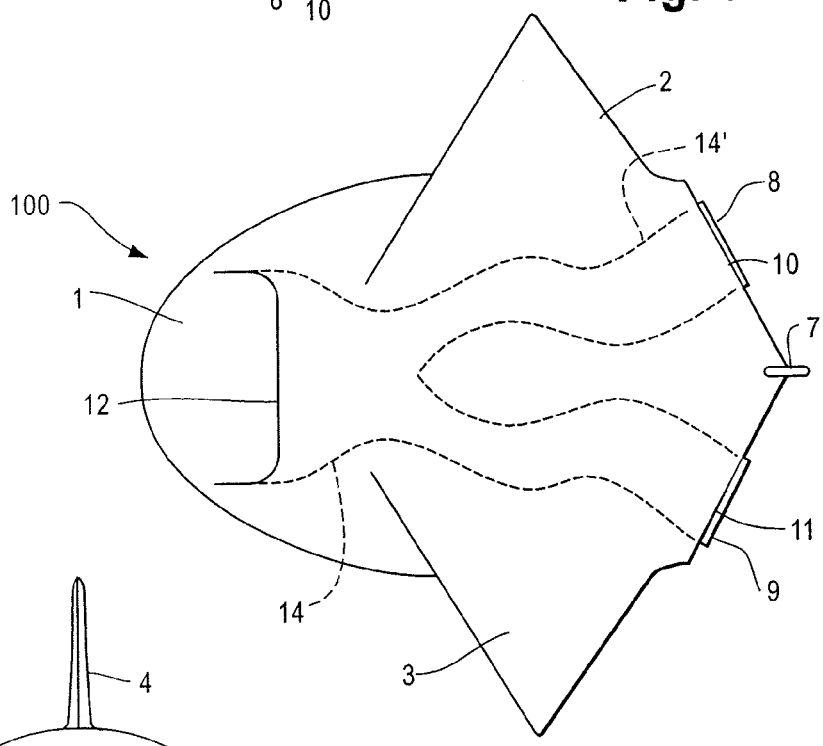
FIG. 5 is a bottom view of a personal watercraft in accordance with the present invention.

FIG. 5 is a bottom view of the watercraft 100 and illustrates the water tunnel 14 that is positioned inside of the hull 1 as dotted lines. The water tunnel 14 is streamlined and is designed such that the same amount of water that enters the craft 100 at the intake 12 flows through the water tunnel 14 and exits the craft 100 at the water exhausts 8 and 9 in the rear of the craft. That is, the amount of water being taken into the craft 100 at the intake 12 is substantially the same as the amount of water exiting the craft 100 at the exhausts 8 and 9 at any given time.

The water tunnel 14 can be elongated and curved at or near the water intake 12. Then, the bottom of the tunnel 14 can gradually slope downward, the top of the tunnel 14 can gradually slope upward, and the sides of the tunnel 14 can gradually slope inward such that the tunnel 14 is round at or near the middle of hull 1 where the propeller 19 is located. The tunnel 14 can have a close clearance relative to the propeller 19, thereby minimizing turbulence. Moving rearward, behind the propeller 19, the water tunnel 14 can split into two back tunnels 14' and 14". Throughout, the back tunnels 14' and 14" can gradually slope downward, and the bottoms of the tunnels 14' and 14" can become flat. The bottoms of the tunnels 14' and 14" can be securely attached to the floor of the craft 100.

In embodiments of the present invention, the back tunnels 14' and 14" can gradually widen from the propeller to the rear of the watercraft 100. The widening of the back tunnels 14' and 14" minimizes turbulence. The tunnels 14' and 14" can become rectangular in shape at the rear of the craft 100 and curve in such a way that the water exhausts 8 and 9 are at an approximately 45° angle from one another.

The water tunnel 14 can be made from fabricated aluminum and be welded together to form a solid structure that is air and water tight, for example. Alternatively, the water tunnel 14 can be molded from a high impact plastic.

Figure 6:
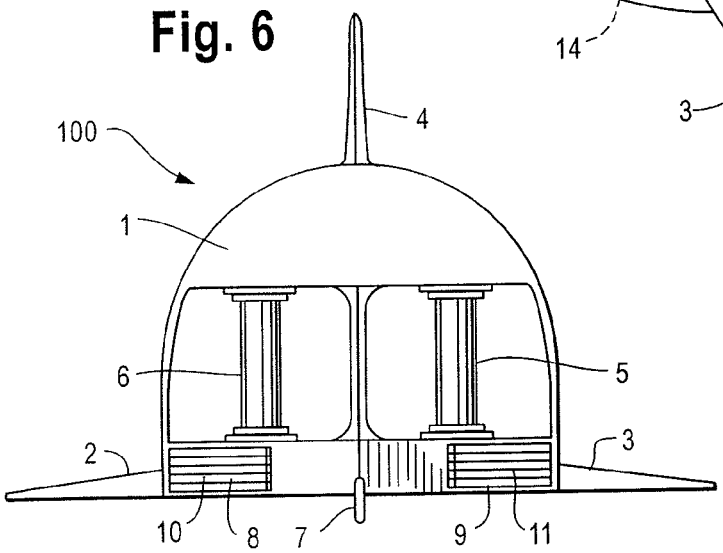
FIG. 6 is a rear view of a personal watercraft in accordance with the present invention.

FIG. 6 is a rear view of the watercraft 100 of FIG. 1. As seen in FIG. 6, handgrips 5 and 6 can be positioned inside of respective hand cavities that are rounded in shape and formed into the hull 1 at the rear of the watercraft 100. The hand cavities can provide room for the hands of a user holding onto the handgrips 5 and 6.

Figure 7:
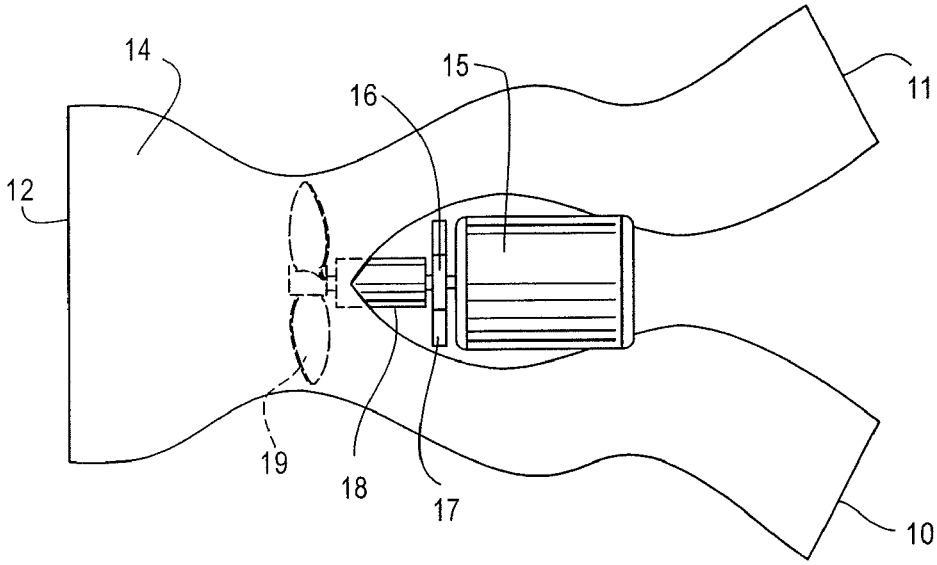
FIG. 7 is a top view of a water tunnel that can be incorporated into a personal watercraft in accordance with the present invention.

FIG. 7 is a top view of the water tunnel 14 as positioned inside of the watercraft 100 of FIG. 1. As seen in FIG. 7, a propeller 19 (shown in dotted lines) can be situated inside of the water tunnel 14 where the tunnel 14 becomes round and there is a tight clearance. A motor 15 can control the propeller 19 and can be connected to the propeller via a drive shaft housing 18, drive shaft gear 17, and motor drive gear 16. In embodiments of the present invention, the motor can be from approximately 18 to 36 volts, for example, and can be similar to the types of motors found in cordless power tools, for example. In further embodiments, and as seen in FIG. 7, the motor 15 is located outside of the water tunnel 14, but still within the hull 1.

Figure 8:
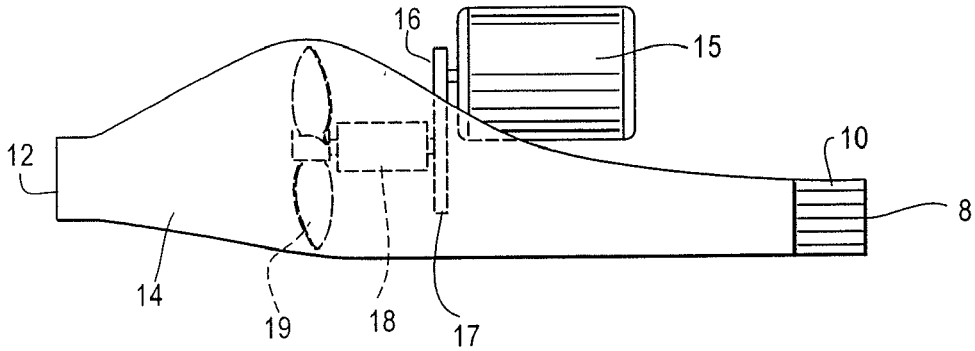
FIG. 8 is a left side view of a water tunnel that can be incorporated into a personal watercraft in accordance with the present invention.
Figure 9:
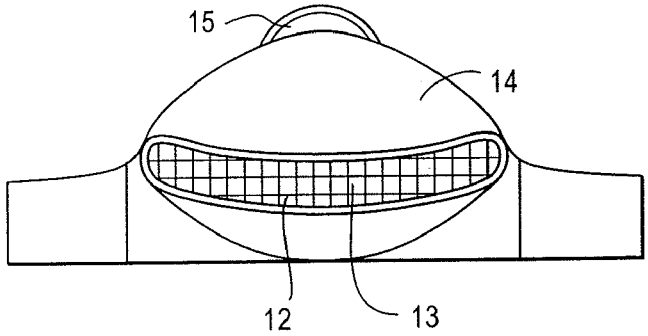
FIG. 9 is a front view of a water tunnel that can be incorporated into a personal watercraft in accordance with the present invention.

FIG. 8 is a left side view of the water tunnel of FIG. 7, and FIG. 9 is a front view of the water tunnel of FIG. 7. It is to be understood that the right side of the water tunnel is a mirror image of the left side. The debris screen 13 as shown in FIG. 9 can be mounted to the water intake 12 in various ways as would be known by those of skill in the art depending on the materials of the water tunnel 14 and the debris screen 13.

Figure 10:
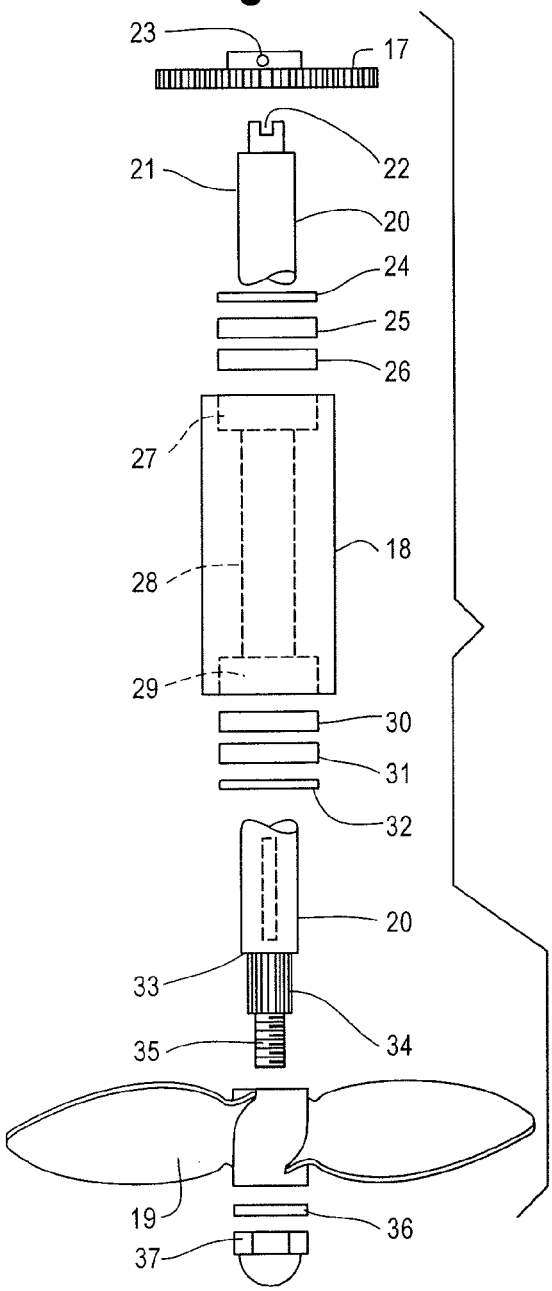
FIG. 10 is an exploded view of a propeller, drive shaft, drive shaft housing, and drive shaft gear that can be incorporated into a personal watercraft in accordance with the present invention.

Referring now to FIG. 10, an exploded view of the parts that link the propeller 19 to the motor 15 is shown. The drive shaft gear 17 can be fitted onto the drive shaft 20 and can rest against a seat 21 made on the drive shaft 20. The drive shaft gear 17 can be secured to the drive shaft 20 by means of a set screw 23 at the flat spot 22 located at the rear end of the drive shaft 20.

The drive shaft 20 can page through the drive shaft housing 18. The housing 18 can include a rear seal 25 and a rear roller bearing 26 placed inside the housing 18 at dotted lines 27. A shim 24 can be used between the drive shaft gear 17 and the rear of the drive shaft housing 18. The drive shaft 20 can pass through the cavity 28 of the drive shaft housing 18, and the cavity 28 can be filled with grease or oil to keep the roller bearings 26 and 30 lubricated. A roller bearing 30 and seal 31 can be located inside the drive shaft housing 18 at or near the front of the drive shaft housing 18, for example, at dotted lines 29.

The front end of the drive shaft 20 can be splined 34 to match splines inside the propeller 19, which can rest against a seat 33 made on the drive shaft 20. In embodiments of the present invention, the propeller 19 can have a diameter of approximately 4.5 inches. A shim 32 can be situated between the propeller 19 and the drive shaft housing 18, and the propeller can be secured to the drive shaft 20 with a washer 36 and a locknut 37 that are secured onto the end of the drive shaft 20 at the threaded section 35.

The propeller 19, drive shaft 20, locknut 27 and washer 36 can be made from stainless steel, for example. The drive shaft housing 18 can be fitted to the water tunnel 14 by welding the housing 18 to the tunnel 14 if the drive shaft housing 18 and the water tunnel 14 are made of aluminum. Alternatively, the drive shaft housing 18 can be attached to the water tunnel 14 in a molding process if the housing 18 and the tunnel 14 are made from high impact plastic. In a method of making the water tunnel 14 in accordance with the present invention, the propeller 19 can be mounted onto the drive shaft 20 and positioned inside the drive shaft housing 18 before the water tunnel 14 is completely formed.

Figure 11:
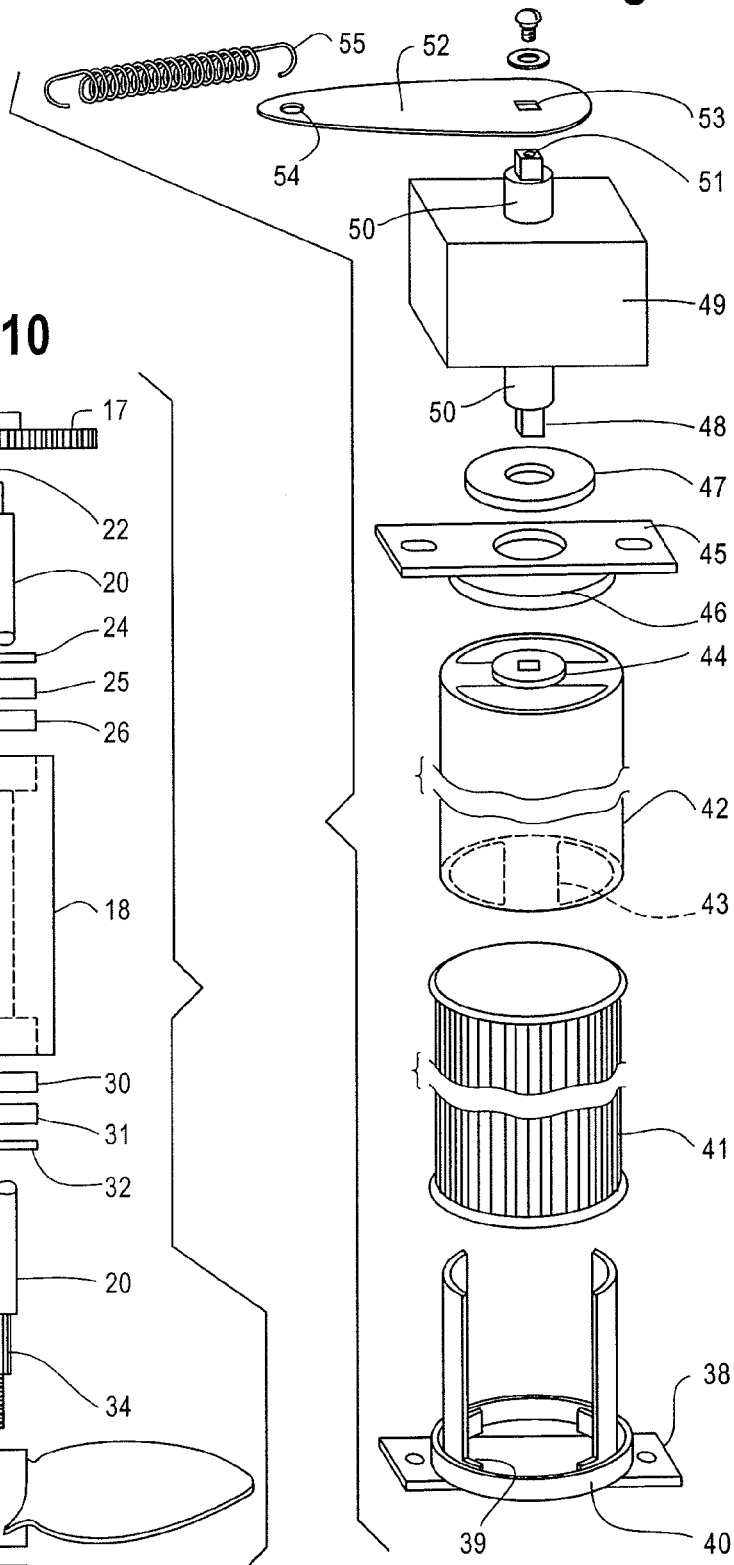
FIG. 11 is an exploded view of a throttle handgrip, variable speed switch, and return lever and spring that can be incorporated into a personal watercraft in accordance with the present invention.

Referring now to FIG. 11, an exploded view of a throttle handgrip, variable speed switch, and return lever and spring that can be incorporated into a personal watercraft in accordance with the present invention is shown. In embodiments of the present invention, the throttle handgrip is the right handgrip 5 of the watercraft 100.

The handgrip 5 can have a bottom mounting bracket 38. A round sleeve 40 and a partial cylinder with stop points 39 can be attached to the bottom mounting bracket 38. The rubber handgrip 41 can slide over the handgrip cylinder 42, which includes a stop bar 43. The handgrip cylinder 42 can slide over the partial cylinder 39, fitting between the partial cylinder 39 and the round sleeve 40.

During operation of the watercraft 100, the handgrip cylinder 42 can be turned until the stop bar 43 contacts the stop points 39 of the partial cylinder. The spacing of the stop bar 43 and the stop points 39 can ensure that the hand grip 5 only rotates one quarter of a turn.

The top of the handgrip cylinder 42 can have a square cut sleeve 44 formed therein. A top mounting bracket 45 can have a round sleeve 46 that fits around the top of the handgrip cylinder 42, and the center of the top mounting bracket 45 can have a round hole so that a variable speed shaft 50 can be connected to the handgrip cylinder 42. The square part 48 of the shaft 50 can be fit into the square sleeve 44 of the handgrip cylinder 42.

A seal 47 can be placed inside the hull 1 of the watercraft 100, and the variable speed switch shaft 50 can pass therethrough. The variable speed switch 49 incorporated into the watercraft 100 can be of a type known by those of skill in the art. However, in embodiments of the present invention, the variable speed switch 49 can only turn one quarter of a turn as well. The variable speed switch 49 can be responsive to the rotation of the handgrip cylinder 42.

In operation, when the handgrip 5 is released, the return lever 52 can shut off the throttle by using a return spring 55. The return spring 55 can be attached to the return lever 52 at hold 54 as well as to a point inside the watercraft 100. The lever 52 can be secured to the variable speed switch shaft 50 via a screw and washer at the top squared portion 51 and the square hole 53 made in the return lever 52. Wiring from the rechargeable battery of the watercraft 100 can run to the variable speed switch 50 and then to the motor.

In embodiments of the present invention in which both the hull 1 and the water tunnel 14 are made from aluminum, for example, the inside wall of the hull 1 and the outside wall of the water tunnel 14 can have a foam layer sprayed on or applied in another manner as would be known by those of skill in the art. The foam layer can prevent condensation from forming in the space between the hull 1 and the water tunnel 14.

From the foregoing, it will be observed that numerous variations and modifications may be effected without departing from the spirit and scope of the invention. It is to be understood that no limitation with respect to the specific apparatus or method illustrated herein is intended or should be inferred. It is, of course, intended to cover by the appended claims all such modifications as fall within the scope of the claims.

What is claimed is:

1. A personal watercraft capable of achieving high speeds and operating on a surface of a body of water or beneath the surface of the body of water comprising:

a hull;

a streamlined water tunnel disposed within the hull;

a plurality of fins extending from the hull;

a propeller disposed within the water tunnel;

a motor disposed within the hull and outside of the water tunnel, the motor controlling the propeller;

a water intake at the front of the water tunnel, the water intake is at the front and bottom of the hull;

first and second water exhausts at the rear of the water tunnel, the first and second water exhausts are at the rear and bottom of the hull, the first and second water exhausts are spaced apart from one another along the rear of the hull and the water tunnel is elongated at the water intake, the water tunnel is circular at the propeller, the water tunnel splits into first and second back tunnels past the propeller, and the first and second tunnels of the water tunnel are rectangular at the first and second water exhausts, respectively;

first and second vertical handgrips located at the rear of the hull;

a tow ring at a center bottom edge of the rear of the hull;

wherein a first amount of water is pulled into the water tunnel via the water intake by the propeller, and the first amount of water is substantially the same as a second amount of water exiting the water tunnel via the water tunnel at the water exhausts to propel the personal watercraft.

* * * * *